US009464528B2

(12) United States Patent
Zhang et al.

(10) Patent No.: US 9,464,528 B2
(45) Date of Patent: Oct. 11, 2016

(54) COOLED TURBINE BLADE WITH DOUBLE COMPOUND ANGLED HOLES AND SLOTS

(71) Applicant: Solar Turbines Incorporated, San Diego, CA (US)

(72) Inventors: Luzeng Zhang, San Diego, CA (US); Juan Yin, San Diego, CA (US); Hee Koo Moon, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 679 days.

(21) Appl. No.: 13/918,052

(22) Filed: Jun. 14, 2013

(65) Prior Publication Data

US 2014/0369852 A1 Dec. 18, 2014

(51) Int. Cl.
*F01D 5/18* (2006.01)

(52) U.S. Cl.
CPC ..... *F01D 5/187* (2013.01); *F01D 5/186* (2013.01); *F05D 2240/304* (2013.01); *F05D 2250/314* (2013.01); *F05D 2250/324* (2013.01); *F05D 2260/202* (2013.01)

(58) Field of Classification Search
CPC .. F01D 5/186; F01D 5/187; F05D 2240/304; F05D 2240/81
See application file for complete search history.

(56) References Cited

U.S. PATENT DOCUMENTS 5,503,529 A * 4/1996 Anselmi ..... F01D 5/186 416/90 R
5,779,437 A 7/1998 Abdel-Messeh et al.
6,514,037 B1 * 2/2003 Danowski ..... F01D 5/186 415/115
6,554,572 B2 4/2003 Rinck et al.
6,554,575 B2 4/2003 Leeke et al.
6,630,645 B2 10/2003 Richter et al.
6,790,005 B2 9/2004 Lee et al.
7,223,072 B2 5/2007 Riahi et al.
7,377,743 B2 5/2008 Flodman et al.
7,621,718 B1 11/2009 Liang
7,682,132 B2 * 3/2010 Sugimoto ..... F01D 5/186 416/97 R
7,850,428 B2 12/2010 Tibbott et al.
8,167,557 B2 5/2012 Elliott et al.
2006/0002796 A1 1/2006 Bolms et al.
2006/0073015 A1 4/2006 Liang
2008/0175714 A1 7/2008 Spangler et al.

* cited by examiner

*Primary Examiner* — Eric Keasel
*Assistant Examiner* — Cameron Corday
(74) *Attorney, Agent, or Firm* — Procopio, Cory, Hargreaves & Savitch LLP

(57) ABSTRACT

A turbine blade for a gas turbine engine. The turbine blade includes a base having a blade root, a platform, a cooling air inlet, and a base air passageway. The turbine blade also includes an airfoil section adjoined to the base and having an outer wall, an airfoil air passageway, a plurality of trailing edge slots in fluid communication with the airfoil air passageway and a plurality of directional film holes through the outer wall in fluid communication with the airfoil air passageway. The plurality of directional film holes includes a first portion configured to discharge the cooling air toward a tip end, and a second portion configured to discharge the cooling air toward the platform.

15 Claims, 4 Drawing Sheets

COOLED TURBINE BLADE WITH DOUBLE COMPOUND ANGLED HOLES AND SLOTS

TECHNICAL FIELD

The present disclosure generally pertains to gas turbine engines, and is more particularly directed toward a cooled turbine blade.

BACKGROUND

High performance gas turbine engines typically rely on increasing turbine inlet temperatures to increase both fuel economy and overall power ratings. These higher temperatures, if not compensated for, oxidize engine components and decrease component life. Component life has been increased by a number of techniques. Said techniques include internal cooling and film cooling with air bled from an engine compressor section. Bleed air extends the life of the blade but results in efficiency loss. Therefore, stationary gas turbines as well as moving gas turbines have limited compressed air for airfoil cooling.

U.S. Pat. No. 6,630,645 issued to Richter, et al. on Oct. 7, 2003 shows a turbine blade of a gas turbine. In particular, the disclosure of Richter, et al. illustrates a turbine blade of a gas turbine in which numerous apertures, formed as cooling-air holes generally run at an acute angle through the component wall. From a cavity in the turbine blade, compressor air is passed through the cooling-air holes, in order to direct a film of cooling air over the outer surface of the turbine blade.

The present disclosure is directed toward overcoming known problems and/or problems discovered by the inventors.

SUMMARY

A turbine blade for a gas turbine engine is disclosed herein. The turbine blade includes a base and an airfoil section adjoined to the base. The base includes a blade root, a platform, a cooling air inlet, and a base air passageway within the base, the base air passageway configured to receive and route cooling air from the cooling air inlet. The airfoil section includes an outer wall extending from the base to a tip end, the outer wall forming a leading edge, a trailing edge, a pressure side, and a suction side. The airfoil section also includes an airfoil air passageway within the outer wall, the airfoil air passageway configured to receive and route the cooling air from the base air passageway. The airfoil section also includes a plurality of trailing edge slots in fluid communication with the airfoil air passageway and configured to discharge a first percentage of the cooling air from the airfoil section. The airfoil section also includes a plurality of directional film holes through the outer wall and each having a film hole inlet and a film hole outlet, the film hole inlet located forward of the film hole outlet, the plurality of directional film holes in fluid communication with the airfoil air passageway and configured to discharge a second percentage of the cooling air. Each of a first portion of the plurality of directional film holes has its film hole inlet located closer to the platform than its film hole outlet, and each of a second portion of the plurality of directional film holes has its film hole outlet located closer to the platform than its film hole inlet. Also, the second portion of the plurality of directional film holes is located closer to the platform than the first portion of the plurality of directional film holes,

DETAILED DESCRIPTION

The current disclosure provides a turbine blade with cooling holes on the pressure side and upstream of the trailing edge slots. Embodiments include directional cooling holes and directional trailing edge slots where cooling air is directed toward the tip and the base of the turbine blade. Using second order cooling effect (or phantom cooling), the discharged cooling air may provide blade cooling to the blade trailing edge tip and platform (endwall) by employing double compound angled design as presently disclosed.

Figure 1:
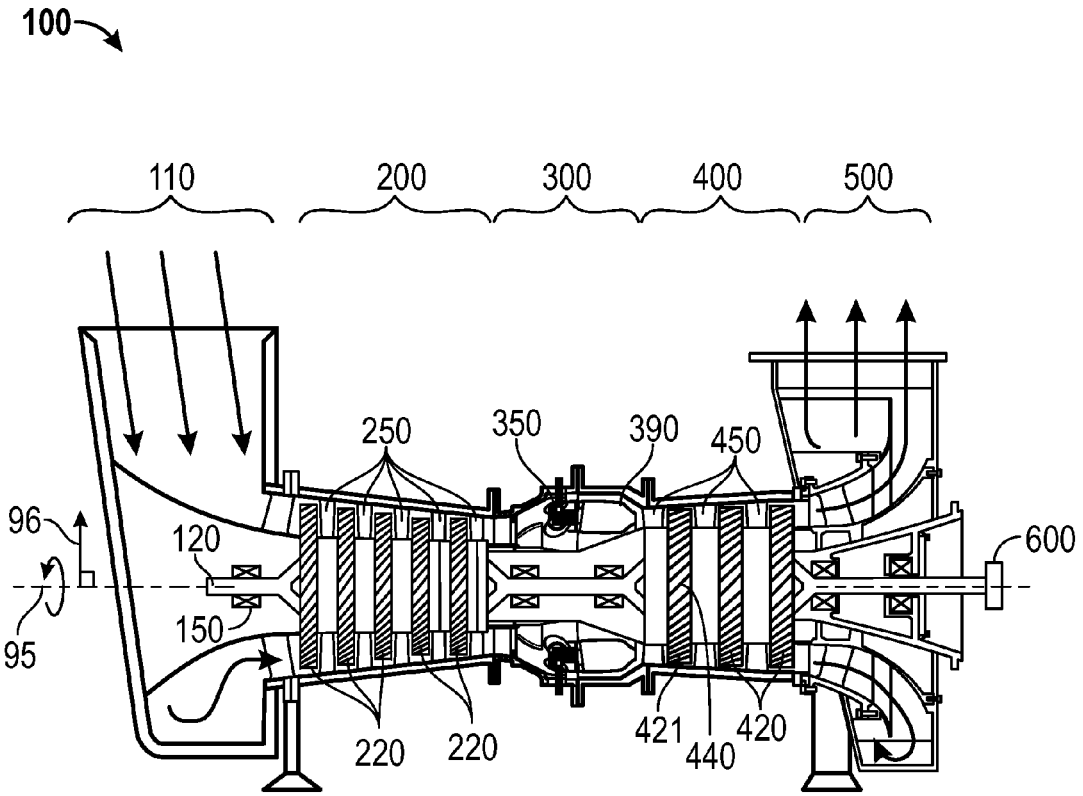
FIG. 1 is a schematic illustration of an exemplary gas turbine engine.

FIG. 1 is a schematic illustration of an exemplary gas turbine engine. Some of the surfaces have been left out or exaggerated (here and in other figures) for clarity and ease of explanation. Also, the disclosure will generally reference a center axis 95 of rotation of the gas turbine engine, which may be generally defined by the longitudinal axis of its shaft 120 (supported by a plurality of bearing assemblies 150). The center axis 95 may be common to or shared with various other engine concentric components. The disclosure will also reference one or more representative radials 96 of the center axis 95.

All references to radial, axial, and circumferential directions and measures refer to center axis 95, unless specified otherwise. In addition, the disclosure may reference a "forward" and an "aft" direction. Generally, all references to "forward" and "aft" are associated with the flow direction of primary air (i.e., air used in the combustion process), unless specified otherwise. For example, forward is "upstream" relative to primary air flow (i.e., towards the point where air enters the system or a leading edge), and aft is "downstream" relative to primary air flow (i.e., towards the point where air leaves the system or a trailing edge).

Structurally, a gas turbine engine 100 includes an inlet 110, a compressor 200, a combustor 300, a turbine 400, an exhaust 500, and a power output coupling 600. The compressor 200 includes one or more compressor rotor assemblies 220. The combustor 300 includes one or more injectors 350 and includes one or more combustion chambers 390. The turbine 400 includes one or more turbine rotor assemblies 420, with a first stage turbine rotor assembly 421 being located closest to the combustor 300. According to one embodiment, one or more of turbine rotor assemblies 420 may be circumferentially populated with a plurality of cooled turbine blades 440, for example, the first stage turbine rotor assembly 421.

As illustrated, both compressor rotor assembly 220 and turbine rotor assembly 420 are axial flow rotor assemblies, where each rotor assembly includes a rotor disk that is circumferentially populated with a plurality of airfoils (e.g., cooled turbine blades 440"). When installed, the rotor blades associated with one rotor disk are axially separated from the rotor blades associated with an adjacent rotor assembly by stationary vanes ("stator vanes" or "nozzles") 250, 450 circumferentially distributed in an annular casing.

One or more of the above components (or their subcomponents) may be made from stainless steel and/or durable, high temperature materials known as "superalloys". A superalloy, or high-performance alloy, is an alloy that exhibits excellent mechanical strength and creep resistance at high temperatures, good surface stability, and corrosion and oxidation resistance. Superalloys may include materials such as HASTELLOY, INCONEL, WASPALOY, RENE alloys, HAYNES alloys, INCOLOY, MP98T, TMS alloys, CMSX single crystal alloys, and the like.

Figure 2:
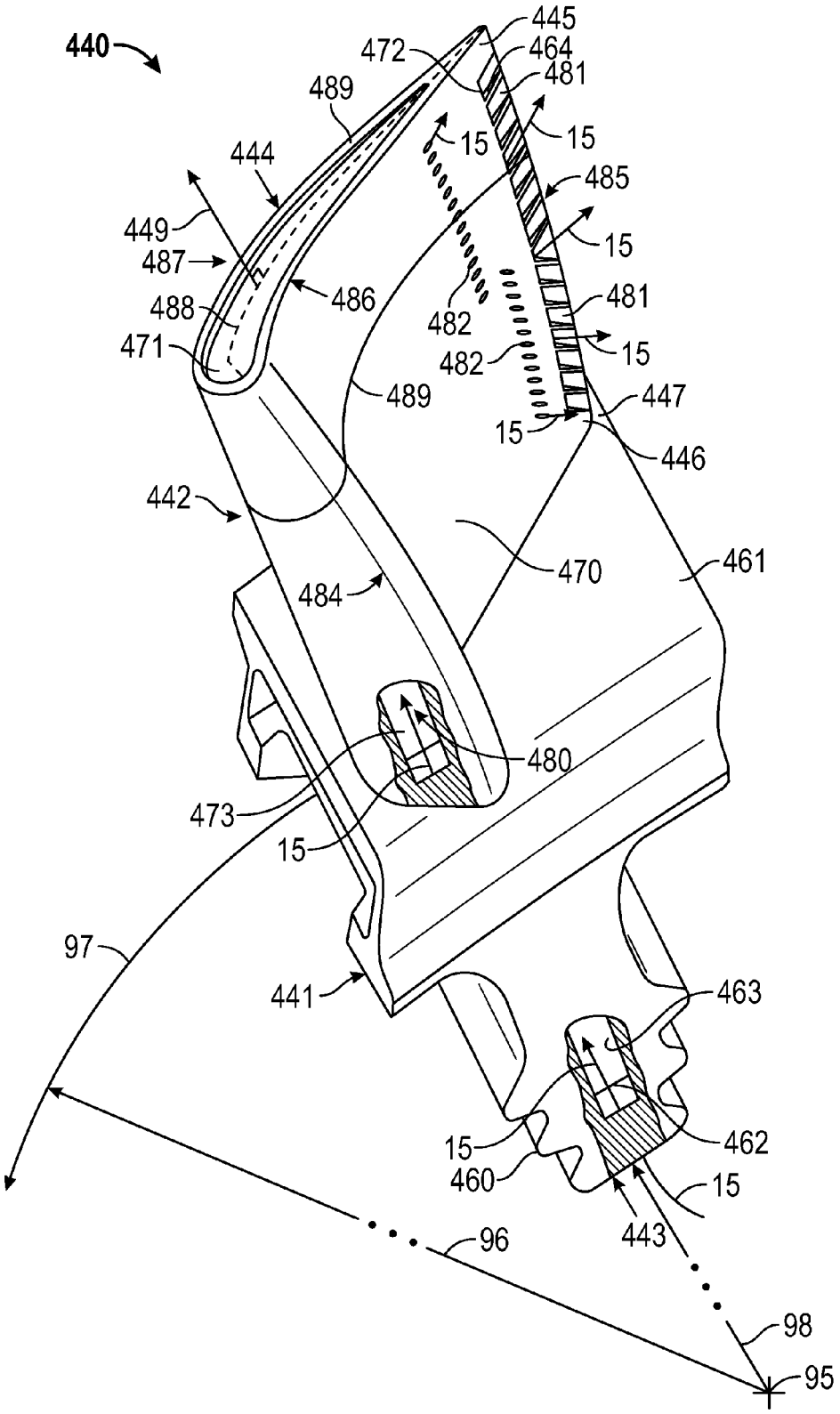
FIG. 2 is a partially cutaway isometric view of the turbine blade of FIG. 1.

FIG. 2 is a partially cutaway isometric view of the turbine blade of FIG. 1. In particular, the cooled turbine blade 440 is shown in isolation from the rest of the gas turbine engine 100, but with reference to the center axis 95, a first radial 96, a second radial 98, and a path of rotation 97 of the cooled turbine blade 440 during operation. For clarity and illustration purposes, certain features/components have been removed. For example, the cooled turbine blade 440 may include additional cooling holes, notches, surfaces, etc. In addition, although the cooled turbine blade 440 is illustrated having film cooling targeting two directions, the concepts presented herein may be extended to multiple directions and/or directions not illustrated in this particular embodiment.

Broadly, the cooled turbine blade 440 includes an airfoil section 442 adjoined to a base 441. In addition, the cooled turbine blade 440 includes a root end 443 on the base 441, and a tip end 444 on the airfoil section 442 and opposite the root end 443. Although film cooling features are only shown here on a downstream portion of the cooled turbine blade 440, the cooled turbine blade 440 may include film cooling features on upstream portions as well.

The airfoil section 442 is a substantially hollow blade configured to receive cooling air 15 from the base 441, to route the cooling air 15 within the airfoil section 442, and to use a percentage of the cooling air 15 for film cooling of targeted areas on the outer surface of the airfoil section 442 and/or the platform 461. Examples of the targeted areas or regions may include the trailing edge tip 445, the trailing edge root 446, and the platform trailing edge 447.

The base 441 includes a blade root 460, a platform 461, a cooling air inlet 462, and a base air passageway 463. The blade root 460 retains the cooled turbine blade 440 in its respective turbine rotor assembly during operation, and may incorporate "fir tree", "bulb", or "dove tail" roots, to list a few.

The platform 461 forms a ground to the airfoil section 442, from which it extends or a frame of reference. The platform 461 is configured to limit downward flow, relative to the platform 461 (i.e., radially inward, relative to the second radial 98) of energized (combusted) gas across the airfoil section 442 during operation. When installed, the platform 461, and also the turbine outer wall (not shown), proximate the tip end 444 serve to form a hot-gas duct (energized-gas duct).

The cooling air inlet 462 may include one or more openings in the base 441 (e.g., proximate the root end 443). The base air passageway 463 may include one or more passageways within the base 441 configured to receive cooling air 15 from the cooling air inlet 462 and route the cooling air 15 to the airfoil section 442. Here, portions of the base 441 have been cut away to illustrate the base air passageway 463 and the cooling air inlet 462.

The airfoil section 442 includes an outer wall 470, an airfoil air passageway 480, a plurality of trailing edge slots 481, and a plurality of directional film holes 482. The outer wall 470 may extend from the platform 461 up to the tip end 444. In particular, the outer wall 470 "spans" between the base 441 and the tip end 444, forming an airfoil surface of the airfoil section 442. As the airfoil surface, the outer wall 470 includes aerodynamic features such as a leading edge 484, a trailing edge 485, a pressure side 486, a suction side 487, a mean camber line 488, and an airfoil shape 489.

The mean camber line 488 is generally defined as the line running along the center of the airfoil from the leading edge 484 to the trailing edge 485. Conventionally, the mean camber line 488 is the average of the pressure side 486 and suction side 487 of the airfoil shape 489. The airfoil shape 489 is generally defined as the shape of the airfoil surface as seen in cross-section, cut in a plane normal to a z-axis 449 (discussed below) at a given point. Accordingly, the airfoil surface of the airfoil section 442 is the integration of the airfoil shape 489 between the platform 461 and the tip end 444.

In addition, the airfoil section 442 may have a complex, geometry that varies between the base 441 and the tip end 444. For example the airfoil shape 489 of the airfoil section 442 may increase camber length, thicken, twist, and/or change shape as it spans downward (referring to the platform 461 as a ground or frame of reference). Moreover, the overall geometry of airfoil section 442 may vary from turbine application to turbine application.

Accordingly, due to its complex geometry, when describing the airfoil section 442, operational aspects of the cooled turbine blade 440 are referenced herein. In particular, referring to the platform 461 as the ground or frame of reference, the "upward" and "downward" directions are measured along a z-axis 449, running from the platform 461 (or a point of interest such as the location of a described feature) up towards the tip end 444. For example, travel in the z-direction from the root end 443 to the tip end 444 is "upward", and vis versa.

Here, the z-axis 449 is conveniently defined as being an axis that is normal to a plane that is tangent to the path of rotation 97 of a given point of interest on the cooled turbine blade 440 (e.g. center of a directional film hole 482) during operation. Accordingly, during operation, the z-axis 449 is coaxial with the second radial 98 of the center axis 95 of the gas turbine engine 100 in which it is installed (see FIG. 1). To illustrate, an exemplary z-axis 449 is shown at a point on the airfoil section 442 along its mean camber line 488.

Aerodynamic features of the outer wall 470 may be referenced herein as well. In particular, the "forward" and "aft" directions of the airfoil section 442 are generally measured between its leading edge 484 (forward) and its trailing edge 485 (aft), along airfoil shape 489. Similarly, when describing the cooling features of the airfoil section 442 (particularly the directional film holes 482), the "inward" and "outward" directions are generally measured relative to the airfoil surface of the airfoil section 442. Specifically, the inward and outward directions are along a line normal to a plane that is tangent to the airfoil surface with "inward" being toward the mean camber line 488 and "outward" being in the opposite direction.

The airfoil section 442 may also include a tip wall 471 at its tip end 444 ("upper" end). The tip wall 471 may extend across the airfoil section 442, substantially or entirely capping off the hollow portions of the outer wall 470. The tip wall 471 may be configured to redirect cooling air 15 from escaping through the tip end 444 (see e.g., FIG. 3). According to one embodiment and as illustrated, the tip wall 471 may be recessed downward (toward the platform 461) such that it is not flush with the tip end 444 of the airfoil section 442. According to one embodiment, the tip wall 471 may include one or more perforations (not shown) such that a percentage of the cooling air 15 may be bled off at the tip end 444.

The airfoil section 442 may also include structures or features within the outer wall 470. The internal structures may include structural members as well as thermodynamic members. For example, the airfoil section 442 may include one or more ribs 473 extending between the pressure side 486 and the suction side 487 of the outer wall 470 (see also, FIG. 3). The one or more ribs 473 may be configured as a frame structure and a heat exchanger within the cooled turbine blade 440, as well as forming part of the airfoil air passageway 480.

The airfoil air passageway 480 may include one or more passageways within the outer wall 470 configured to receive cooling air 15 from the base air passageway 463 and route the cooling air 15 through and out of the outer wall 470. As above, portions of the airfoil section 442 have been cut away to illustrate the airfoil air passageway 480. The one or more passageways may include any combination of cavities, internal ducting, free space, and openings within the outer wall 470. Additionally, the airfoil air passageway 480 may include passageways that are joined or segregated. The airfoil air passageway 480 may terminate at various openings in the outer wall 470. For example, portions of the airfoil air passageway 480 may terminate at a trailing edge slot 481, a directional film hole 482, and/or a perforation in the tip wall 471, providing egress for the cooling air 15 from the cooled turbine blade 440 during operation.

The plurality of trailing edge slots 481 are a series of openings configured to discharge a percentage of the cooling air 15 from the cooled turbine blade 440. In particular, the trailing edge slots 481 may be openings stratified between the platform 461 and the tip end 444, proximate the trailing edge 485 of the airfoil section 442. The openings may be of a rectilinear cross section, an angular cross section, a rounded cross section, or any combination thereof. In addition, the trailing edge slots 481 are in fluid communication with the airfoil air passageway 480 and may be configured to discharge the vast majority of the cooling air 15 received by the airfoil air passageway 480.

According to one embodiment, the trailing edge slots 481 may be integrated into the outer wall 470. In particular and as illustrated, at least a portion of suction side 487 of the outer wall 470 may extend further downstream than the pressure side 486 of the outer wall 470, exposing a discontinuity therebetween. A series of trailing edge slats 464 may then extend through the discontinuity, between the suction side 487 of the outer wall 470 and pressure side 486 of the outer wall 470. In particular, the series of trailing edge slats 464 may have a generally triangular shape with an apex proximate the trailing edge 485 and a base extending between a pressure side trailing edge 472 of the outer wall 470 and the suction side 487 of the outer wall 470. In addition, the trailing edge slats 464 may continue upstream between the pressure side 486 of the outer wall 470 and the suction side 487 of the outer wall 470 within the airfoil section 442, transitioning into a rib 473 or other internal structure. According to one embodiment, the trailing edge slats 464 may be configured as cooling fins for one or more components of the airfoil section 442 (e.g., outer wall 470, rib 473, etc.).

The plurality of directional film holes 482 includes a series of openings configured to discharge a percentage of the cooling air 15 from the cooled turbine blade 440. In particular, the directional film holes 482 are passageways through the outer wall 470. In addition, the directional film holes 482 are in fluid communication with the airfoil air passageway 480 and may be configured to discharge a small percentage of the cooling air 15 received by the airfoil air passageway 480 for film cooling of outer surfaces of the cooled turbine blade 440. For example, the directional film holes 482 may be distributed between the platform 461 and the tip end 444, proximate the trailing edge 485 of the airfoil section 442. In addition, the directional film holes 482 are "directional" in that they are configured to direct the small percentage of the cooling air 15 in a direction having a non-zero angle in the z-direction (e.g., angled "up" or "down", relative to the platform 461), as discussed further below.

Together or independently, the trailing edge slots 481 and the plurality of directional film holes 482 may be configured to strategically discharge the cooling air 15 in a spanwise film to local hot spots and/or difficult-to-reach locations. For example, manufacturing or other limitations may require offsetting the outermost trailing edge slots 481 and/or the outermost directional film hole 482 from the tip end 444 or the platform 461. In contrast to discharging along a streamline, they may be angled relative to their position to specifically reach the trailing edge tip 445, the trailing edge root 446, and/or the platform trailing edge 447 while maintaining a continuous spanwise film in between.

Figure 3:
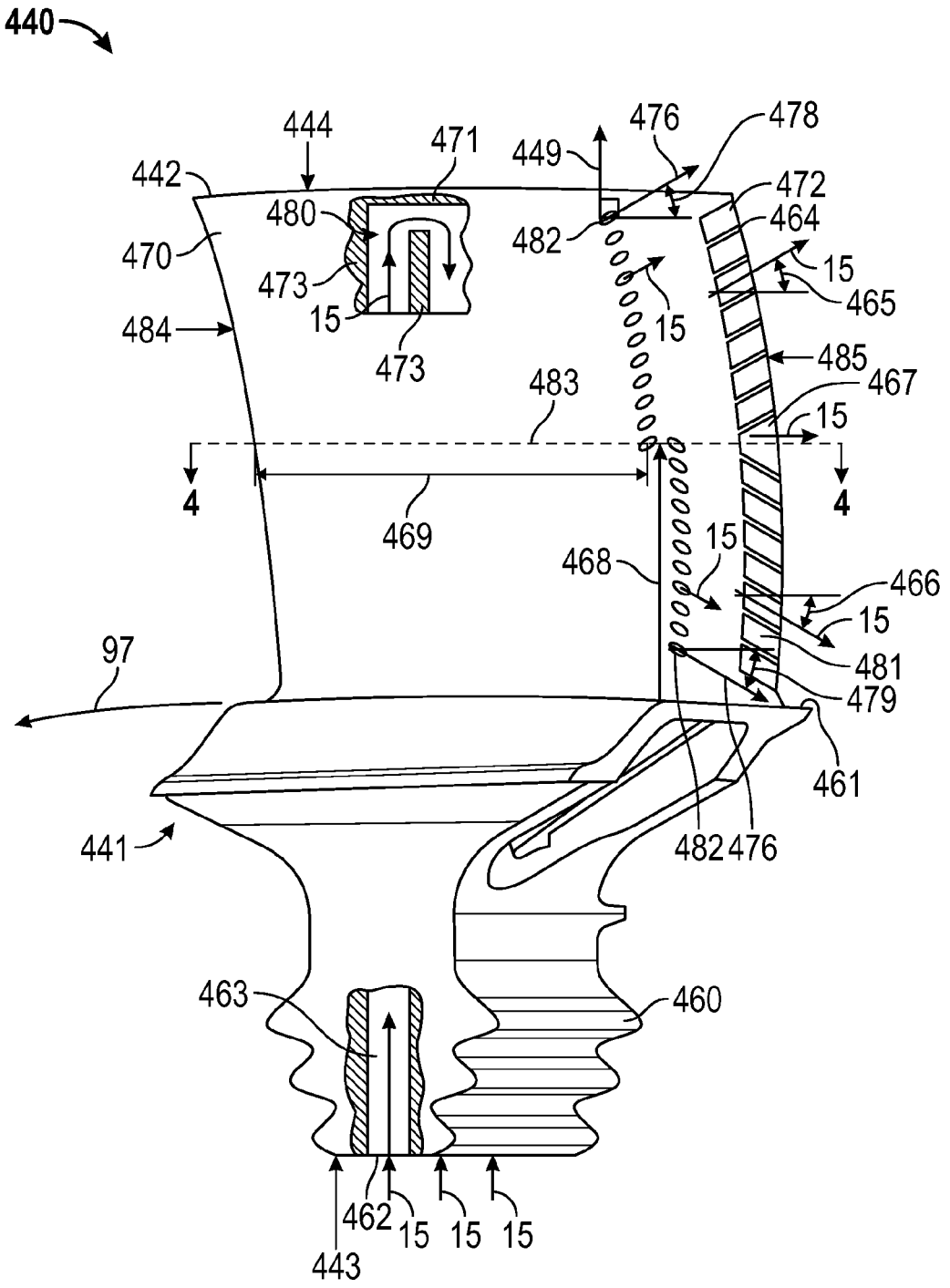
FIG. 3 is a partially cutaway pressure side view of the turbine blade of FIG. 2.
Figure 4:
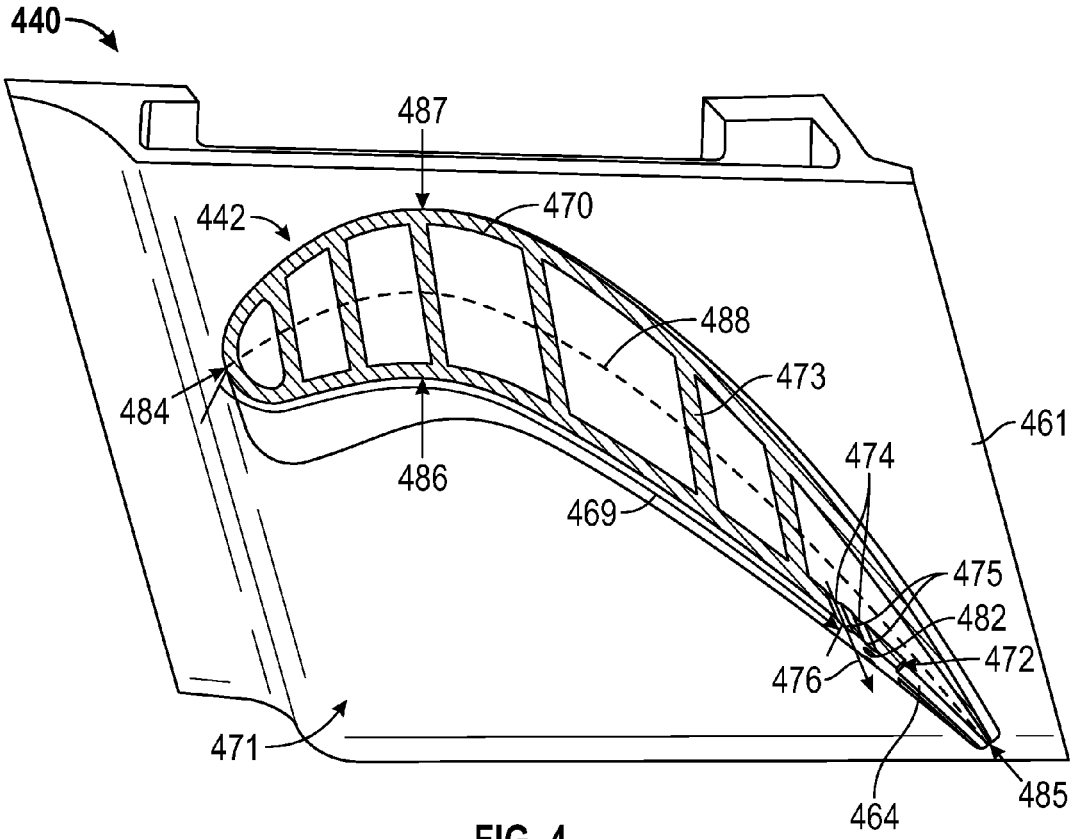
FIG. 4 is a sectional top view of the turbine blade of FIG. 3, taken along section cut line 4-4.

FIG. 3 is a partially cutaway side pressure view of the turbine blade of FIG. 2. In particular, the side view coincides with an axial view of the gas turbine engine 100 when the cooled turbine blade 440 is installed (see FIG. 1). For example, when installed, the illustrated side view would be looking aft (inlet 110 towards exhaust 500) along the center axis 95, with a counterclockwise path of rotation 97. FIG. 4 is a sectional top view of the turbine blade of FIG. 3, taken along section cut line 4-4. As above, certain features/components have been removed for clarity and illustration purposes. For example, portions of the cooled turbine blade 440 are cut away to illustrate exemplary passageways for the cooling air 15 to be routed. In particular, the cooling air 15 is shown traveling in a serpentine path (e.g., redirected by the tip wall 471) through the airfoil air passageway 480.

With reference to the plurality of directional film holes 482 discussed above, the location of each directional film hole 482 may be conveniently defined by the center of its film hole outlet 475. In addition, the position of the directional film hole 482 may be conveniently defined by a distance from the platform 461 in its z-direction (e.g., vertical position 468), and a distance from the leading edge 484 of its location along the curve of an airfoil shape 489 passing through it (e.g., horizontal position 469). The airfoil shape 489 may be approximated by a curve on the airfoil surface between the leading edge 484 and the trailing edge 485 that is equidistant in the z-direction from the platform 461 and/or the tip end 444. Alternately, the airfoil shape 489 may be approximated by a streamline proximate the directional film hole 482 of interest.

For example, the position of a directional film hole 482 on the airfoil section 442 may be approximated and described by its particular span length from the platform 461 (vertical position 468) and the percent of a length from the leading edge 484 to the trailing edge 485 along a curved line such as described above, e.g., airfoil shape, equidistant, streamline, etc., (horizontal position 469). Also for example, the position of a directional film hole 482 on the airfoil section 442 may be approximated and described by its particular span length from the platform 461 (vertical position 468) and distance from the leading edge 484 along a curved line such as described above (horizontal position 469).

As illustrated, the plurality of directional film holes 482 may be positioned on the pressure side 486 of the airfoil section 442, toward the trailing edge 485. In particular, the plurality of directional film holes 482 pass through the outer wall 470 on the pressure side 486 of the airfoil section 442, and are positioned on the airfoil surface of the outer wall 470 downstream from the leading edge 484 by at least half of the length from the leading edge 484 to the trailing edge 485 between sixty and ninety percent of the length from the leading edge 484 to the trailing edge 485, measured along the outer wall 470.

For example, the plurality of directional film holes 482 may be positioned downstream at least sixty percent of the length from the leading edge 484 to the trailing edge 485. Also for example, the plurality of directional film holes 482 may be positioned downstream at least seventy percent of the length from the leading edge 484 to the trailing edge 485. Also for example, the plurality of directional film holes 482 may be positioned downstream between sixty and ninety percent of the length from the leading edge 484 to the trailing edge 485. Also for example, the plurality of directional film holes 482 may be positioned downstream between sixty-five and eighty-five percent of the length from the leading edge 484 to the trailing edge 485.

In general, the directional film holes 482 may be configured to discharge a film of cooling air 15 toward hotter areas of the cooled turbine blade 440. As discussed above, the plurality of directional film holes 482 are configured to discharge cooling air 15 in a direction having a non-zero angle in the z-direction or away from a film transition line 483 (here, the film transition line 483 coincides with the section cut line 4-4). In particular, some of the directional film holes 482 may direct cooling air 15 toward the tip end 444 (upward, relative to its respective z-axis 449), and other directional film holes 482 may direct cooling air 15 toward the platform 461 (downward, relative to its respective z-axis 449).

According to one embodiment, the plurality of directional film holes 482 may be angled downstream, and angled away from the film transition line 483. In particular, each film hole inlet 474 is located forward of its respective film hole outlet 475, providing for a film discharge direction 476 to point in a downstream direction (discussed further below). In addition, each film hole inlet 474 is closer to the film transition line 483 than its respective film hole outlet 475, providing for the film discharge direction 476 to be angled away from the film transition line 483. Note, here, the film transition line 483 is illustrated as line approximately at mid-span of the airfoil section 442, however, in other embodiments, the film transition line 483 may be offset from mid-span (e.g., located closer to or farther from the tip end 444 than the mid-span of the airfoil section 442).

According to one embodiment, a first portion of the plurality of directional film holes 482 may be configured to discharge cooling air 15 from the outer wall 470 upward at a first target angle 478 and a second portion of the plurality of directional film holes 482 may be configured to discharge cooling air 15 from the outer wall 470 downward at a second target angle 479. As illustrated, the first target angle 478 and the second target angle 479 may be conveniently represented as an angle between the film discharge direction 476 of a directional film hole 482 and a plane normal to its respective z-axis 449, the angle measured in a plane formed by the film discharge direction 476 and the respective z-axis 449.

For example, the first target angle 478 may be approximately 30 degrees in the positive direction and the second target angle 479 may be approximately 30 degrees in the negative direction. Also for example, the first target angle 478 may be approximately 15 degrees to 30 degrees in the positive direction and the second target angle 479 may be approximately 15 degrees to 30 degrees in the negative direction. Also for example, the first target angle 478 may be approximately 10 degrees to 40 degrees in the positive direction and the second target angle 479 may be approximately 10 degrees to 40 degrees in the negative direction. Also for example, the first target angle 478 and the second target angle 479 may be correspond to be substantially similar to a first trailing edge angle 465 and a second trailing edge angle 466 of the trailing edge slots 481.

According to one embodiment, the first target angle 478 and the second target angle 479 may be reflections of each other, having substantially the same angle but being the negative of each other. According to another embodiment, the first target angle 478 and the second target angle 479 may differ from each other in both scalar value (absolute values of angle) and in direction (angle sign). Moreover, each of the plurality of directional film holes 482 may be configured to discharge cooling air 15 from the outer wall 470 at a target angle independent of the other directional film holes 482.

According to one embodiment, the plurality of directional film holes 482 may be configured to distribute the cooling film spanwise across the airfoil section 442. In particular, the directional film holes 482 may be stratified between the platform 461 and the tip end 444, or a portion therebetween. Moreover, the plurality of directional film holes 482 may be spaced such that continuous film coverage is provided. For example, the directional film holes 482 may be distributed spanwise with a pitch-to-diameter ratio (P/D) of 4, or within a P/D range of 3-5 or 2-7. Here, the pitch-to-diameter ratio is measured center-to-center along a line in the z-direction using the cut diameter (here circular diameter normal to film hole discharge direction 476) of the respective film hole outlet 475.

According to one embodiment, the plurality of directional film holes 482 may be positioned within a strip or column. In particular, the plurality of directional film holes 482 may be distributed spanwise while limiting their horizontal position 469 from the leading edge 484 to a range. For example, the plurality of directional film holes 482 may remain within a horizontal range of 20 percent of the total length from the leading edge 484 to the trailing edge 485 along a curved line such as described above. Also for example, the directional film holes 482 may remain within horizontal range of 5 diameters of each. Furthermore, the spanwise distribution may form a single line, a plurality of lines, a staggered array, or other distribution stratified between the platform 461 and the tip end 444 and within the strip or column.

According to one embodiment, the plurality of directional film holes 482 may include a first spanwise array of directional film holes 482 (e.g., single-column, plural-column, or any other spanwise distribution) having a first target angle 478, and a second spanwise array of directional film holes 482 having a second target angle 479, the second target angle 479 being different from the first target angle 478. As illustrated, the first spanwise array of directional film holes 482 and the second spanwise array of directional film holes 482 may each form a single column spanning part of the airfoil section 442 (here, a top half-span and a bottom half-span, respectively). For example, the first spanwise array of directional film holes 482 may extend spanwise on one side of the film transition line 483 toward the tip end 444, and the second spanwise array of directional film holes 482 may extend spanwise on the other side of the film transition line 483 toward the platform 461. In addition, the first target angle 478 and the second target angle 479 each point downstream and away from the film transition line 483.

Moreover, the first and the second spanwise arrays of directional film holes 482 described above may be offset and overlap each other. In particular and as illustrated, two half-span arrays of directional film holes 482 overlap each other in the flow direction (here, along their horizontal position 469) to avoid weak film coverage in the mid-span. For example, the first spanwise array may be offset, or positioned upstream of the second spanwise array, or vis versa.

In addition, at least one directional film hole 482 of the first spanwise array may be located on the same side of the film transition line 483 as the second spanwise array, and at least one directional film hole 482 of the second spanwise array may be located on the same side of the film transition line 483 as the first spanwise array. Alternately, one directional film hole 482 of the first spanwise array may be located on the film transition line 483 and one directional film hole 482 of the second spanwise array may be located on the film transition line 483. Additional directional film holes 482 having the first target angle 478 and the second target angle 479 may overlap each other in the flow direction as well.

According to one embodiment, the first spanwise array may have a first beginning directional film hole 482 nearest the tip end 444 and a first ending directional film hole 482 farthest from the tip end 444 forming a first "single-column" spanwise array. Also, the second spanwise array may have a second beginning directional film hole 482 nearest the platform 461 and a second ending directional film hole 482 farthest from the platform 461. In addition, the first ending directional film hole 482 may be positioned equidistant or closer to the platform 461 than the second ending directional film hole 482, thus overlapping each other. Similarly, the second ending directional film hole 482 may be positioned equidistant or closer to the tip end 444 than the first ending directional film hole 482.

According to one embodiment, the plurality of trailing edge slots 481 may be configured to discharge cooling air 15 from the cooled turbine blade 440 upward and downward, relative to the platform 461 as a ground. In particular, an upper portion of the plurality of trailing edge slots 481 may be tilted, angled, or otherwise configured to discharge cooling air 15 from the cooled turbine blade 440 at least partially upward, relative to the platform 461 as a ground (i.e., including a velocity component toward the tip end 444). Likewise, a lower portion of the plurality of trailing edge slots 481 may be tilted, angled, or otherwise configured to discharge cooling air 15 from the cooled turbine blade 440 at least partially downward, relative to the platform 461 as a ground (i.e., including a velocity component toward the platform 461).

In addition, the openings of the plurality of trailing edge slots 481 may include guides or other structures of the configured to impart a flow component in the z-direction. For example, the plurality of trailing edge slots 481 may include a plurality of trailing edge slats 464 that are angled and span the trailing edge 485. In particular, the upper portion of the plurality of trailing edge slots 481 may include a first series of trailing edge slats 464 that are angled at a first trailing edge angle 465, and a second series of trailing edge slats 464 that are angled at a second trailing edge angle 466.

The first trailing edge angle 465 and the second trailing edge angle 466 may be conveniently represented as an angle between a discharge direction of cooling air 15 from each trailing edge slot 481 and a plane normal to its respective z-axis 449, the angle measured in a plane formed by the discharge direction and the respective z-axis 449. Where the trailing edge slat 464 is substantially planar or flat in shape, the first trailing edge angle 465 and the second trailing edge angle 466 may be conveniently measured as an angle between the trailing edge slat 464 and a plane normal to its respective z-axis 449.

According to one embodiment, the first trailing edge angle 465 may be approximately 30 degrees in the positive direction; and the second trailing edge angle 466 may be approximately 30 degrees in the negative direction. Alternately, the first trailing edge angle 465 may be approximately 15 degrees to 30 degrees in the positive direction; and the second trailing edge angle 466 may be approximately 15 degrees to 30 degrees in the negative direction. Alternately, the first trailing edge angle 465 may be approximately 10 degrees to 40 degrees in the positive direction; and the second trailing edge angle 466 may be approximately 10 degrees to 40 degrees in the negative direction.

According to another embodiment, the first trailing edge angle 465 and the second trailing edge angle 466 may be tied to each other. In particular, the first trailing edge angle 465 and the second trailing edge angle 466 may be reflections of each other, having substantially the same angle but being the negative of each other. Alternately, the first trailing edge angle 465 and the second trailing edge angle 466 may differ from each other in both scalar value (absolute values of angle) and in direction (angle sign). Moreover, each of the plurality of trailing edge slots 481 may be configured to discharge cooling air 15 from the cooled turbine blade 440 at a trailing edge angle independent of the other trailing edge slots 481.

According to one embodiment, the plurality of trailing edge slots 481 may include a fan slot 467. The fan slot 467 is a transition between the upper and lower portions of the plurality of trailing edge slots 481. In particular, the fan slot 467 be may be configured to discharge cooling air 15 from the cooled turbine blade 440 upward, downward, and in between. For example, the fan slot 467 may include two adjacent but separated trailing edge slats 464 having the first trailing edge angle 465 and the second trailing edge angle 466, respectively, and oriented such that they fan out (i.e., such that their upstream ends are closer to each other than their downstream ends). The fan slot 467 may have a generally trapezoidal shape with the trailing edge 485 and the pressure side trailing edge 472 forming its parallel sides. Moreover, the two adjacent but separated trailing edge slats 464 may be symmetric about a centerline therebetween. Alternately, the two adjacent but separated trailing edge slats 464 may be asymmetric.

In addition, the fan slot 467 may be coordinated with the first and the second spanwise arrays of directional film holes 482 described above. In particular, the fan slot 467 may be symmetric about the film transition line 483. Alternately, the two adjacent but separated trailing edge slats 464 may be positioned on opposite sides of the film transition line 483.

Figure 5:
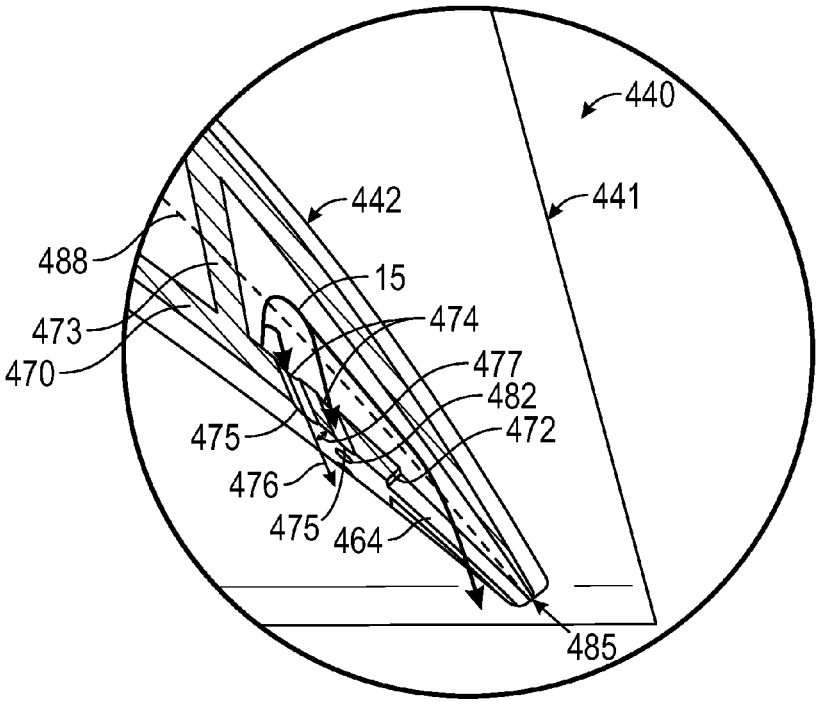
FIG. 5 is a magnified view of a portion of FIG. 4.

FIG. 5 is a magnified view of a portion of FIG. 4. As illustrated, each directional film hole 482 may include a film hole inlet 474 and a film hole outlet 475. The cooling air 15 may be discharged from the cooled turbine blade 440 by passing from the film hole inlet 474 to the film hole outlet 475 along the film discharge direction 476. The film discharge direction 476 may be conveniently defined as the direction from the center of the film hole inlet 474 to the center of the film hole outlet 475. The film discharge direction 476 may conveniently be described by a film hole discharge angle 477 and its respective target angle 478, 479.

Generally, the film hole discharge angle 477 is an angle formed between the film discharge direction 476 and the airfoil surface of the outer wall 470. More specifically, the film hole discharge angle 477 is the angle formed between the film discharge direction 476 and a plane tangent to the airfoil surface (notwithstanding any discontinuities in the airfoil surface), as measured in a plane normal to the z-axis 449 at the location of the directional film hole 482 (as described below). According to one embodiment, the plurality of directional film holes 482 may each have a film hole discharge angle 477 of 30 degrees of less. According to another embodiment, the plurality of directional film holes 482 may each have a film hole discharge angle 477 between 20 degrees and 30 degrees. According to yet another embodiment, the plurality of directional film holes 482 may each have a film hole discharge angle 477 between 15 degrees and 45 degrees. In addition, the plurality of directional film holes 482 may have substantially the same film hole discharge angle 477, independent of one another, or some combination thereof.

INDUSTRIAL APPLICABILITY

The present disclosure generally applies to cooled turbine blades, and gas turbine engines having cooled turbine blades. The described embodiments are not limited to use in conjunction with a particular type of gas turbine engine, but rather may be applied to stationary or motive gas turbine engines, or any variant thereof. Gas turbine engines, and thus their components, may be suited for any number of industrial applications, such as, but not limited to, various aspects of the oil and natural gas industry (including include transmission, gathering, storage, withdrawal, and lifting of oil and natural gas), power generation industry, cogeneration, aerospace and transportation industry, to name a few examples.

Generally, embodiments of the presently disclosed cooled turbine blades are applicable to the use, assembly, manufacture, operation, maintenance, repair, and improvement of gas turbine engines, and may be used in order to improve performance and efficiency, decrease maintenance and repair, and/or lower costs. In addition, embodiments of the presently disclosed cooled turbine blades may be applicable at any stage of the gas turbine engine's life, from design to prototyping and first manufacture, and onward to end of life. Accordingly, the cooled turbine blades may be used in a first product, as a retrofit or enhancement to existing gas turbine engine, as a preventative measure, or even in response to an event.

This is particularly true as the presently disclosed cooled turbine blades may conveniently include identical interfaces to be interchangeable with an earlier type of cooled turbine blades. Moreover, the presently disclosed cooled turbine blades may conveniently include directional film holes and trailing edge slots configured to match a cooling mass flow so as to be further interchangeable.

In operation, pressurized cooling air is provided to the cooled turbine blade via the cooling air inlet. The cooling air is then routed through the base and the airfoil section via the base air passageway and the airfoil passageway, respectively, and discharged through the directional film holes and trailing edge slots. In addition, to the second order cooling effect, the double compound angles may be selected for targeting hot areas. Also, the directional film holes may be offset and overlapped to avoid weak film coverage where their targeting angles transition. The trailing edge slots and the fan slot may be coordinated with the directional film holes and their transition.

In addition, the presently disclosed cooled turbine blades may include variations to discharge angles of one or more of the directional film holes and trailing edge slots while holding cooling mass flow constant. In this way, turbine blade trailing edge tip and root metal temperature may be reduced by re-targeting the directional film holes and trailing edge slots (e.g., in response to aging data, testing, thermo analysis, and/or empirical determinations) without having to increase cooling mass flow to the cooled turbine blades. In this way turbine airfoil cooling design may be optimized, save cooling mass flow and improve turbine efficiency. Moreover, spent cooling air (i.e., cooling air that has already convected heat from inside the cooled turbine blade) may be reused to provide additional service, cooling the outside of cooled the turbine blade.

The preceding detailed description is merely exemplary in nature and is not intended to limit the invention or the application and uses of the invention. The described embodiments are not limited to use in conjunction with a particular type of gas turbine engine. Hence, although the present embodiments are, for convenience of explanation, depicted and described as being implemented in a stationary gas turbine engine, it will be appreciated that it can be implemented in various other types of gas turbine engines, and in various other systems and environments. Furthermore, there is no intention to be bound by any theory presented in any preceding section. It is also understood that the illustrations may include exaggerated dimensions and graphical representation to better illustrate the referenced items shown, and are not consider limiting unless expressly stated as such.

What is claimed is:

1. A turbine blade for a gas turbine engine, the turbine blade having a tip end and a root end, the turbine blade comprising:

a base including a blade root, a platform, a cooling air inlet, and a base air passageway within the base, the base air passageway being configured to receive cooling air from the cooling air inlet and route the cooling air through the base air passageway; and an airfoil section adjoined to the base, the airfoil section including an outer wall extending from the base to the tip end, the outer wall forming a leading edge, a trailing edge, a pressure side, and a suction side, an airfoil air passageway within the outer wall, the airfoil air passageway configured to receive the cooling air from the base air passageway and route the cooling air through the airfoil air passageway, a plurality of trailing edge slots in fluid communication with the airfoil air passageway and configured to discharge a first percentage of the cooling air from the airfoil section, and a plurality of directional film holes through the outer wall, each film hole of the plurality of directional film holes having a film hole inlet and a film hole outlet, the film hole inlet being located closer to the leading edge than the film hole outlet, the plurality of directional film holes being in fluid communication with the airfoil air passageway and being configured to discharge a second percentage of the cooling air, the plurality of directional film holes including a first portion of film holes and a second portion of film holes, each film hole of the first portion of film holes having the film hole inlet located closer to the platform than the film hole outlet, respectively, and being configured to discharge the cooling air toward the tip end at a first target angle relative to the platform, the second portion of film holes being located closer to the platform than the first portion of film holes, each film hole of the second portion of film holes having the film hole outlet located closer to the platform than the film hole inlet, respectively, and being configured to discharge the cooling air toward the platform at a second target angle relative to the platform, wherein an upper portion of the plurality of trailing edge slots is configured to discharge the cooling air from the turbine blade upward at a first trailing edge angle relative to the platform, a lower portion of the plurality of trailing edge slots is configured to discharge the cooling air from the turbine blade downward at a second trailing edge angle relative to the platform, the first target angle is substantially the same as the first trailing edge angle, the second target angle is substantially the same as the second trailing edge angle, the plurality of trailing edge slots includes a fan slot positioned between the upper portion of the plurality of trailing edge slots and the lower portion of the plurality of trailing edge slots, the fan slot being configured to discharge the cooling air upward, downward, and in between, the first portion of film holes and the upper portion of the plurality of trailing edge slots extend between a film transition line and the tip end, and the second portion of film holes and the lower portion of the plurality of trailing edge slots extend between the film transition line and the platform.

2. The turbine blade of claim 1, wherein the first portion of film holes are stratified between the tip end and a film transition line;

wherein the second portion of film holes are stratified between the film transition line and the platform; and wherein the plurality of directional film holes are distributed spanwise with a pitch-to-diameter ratio (P/D) ranging from 2 to 7.

3. The turbine blade of claim 1, wherein the first portion of film holes extend from a film transition line toward the tip end as a first single-column spanwise array;

wherein the second portion of film holes extend from the film transition line toward the platform as a second single-column spanwise array;

wherein one of the first single-column spanwise array and the second single-column spanwise array is positioned upstream of the other;

wherein one film hole of the first portion of film holes is positioned on or between the film transition line and the platform; and wherein one film hole of the second portion of film holes is positioned on or between the film transition line and the tip end.

4. A turbine rotor assembly for the gas turbine engine including a plurality of turbine blades, each turbine blade of the plurality of turbine blades being the turbine blade of claim 1, the turbine rotor assembly comprising a rotor disk that is circumferentially populated with the plurality of turbine blades.

5. A turbine blade for a gas turbine engine, the turbine blade having a tip end and a root end, the turbine blade comprising:

a base including a blade root, a platform, a cooling air inlet, and a base air passageway within the base, the base air passageway being configured to receive cooling air from the cooling air inlet and route the cooling air through the base air passageway; and an airfoil section adjoined to the base, the airfoil section including an outer wall extending from the base to a tip end, the outer wall forming a leading edge, a trailing edge, a pressure side, and a suction side, an airfoil air passageway within the outer wall, the airfoil air passageway being configured to receive the cooling air from the base air passageway and route the cooling air through the airfoil air passageway, a plurality of trailing edge slots in fluid communication with the airfoil air passageway and configured to discharge a first percentage of the cooling air from the airfoil section, and a plurality of directional film holes through the pressure side of the outer wall, the plurality of directional film holes being in fluid communication with the airfoil air passageway and being configured to discharge a second percentage of the cooling air, the plurality of directional film holes including a first portion of film holes and a second portion of film holes, the first portion of film holes being configured to discharge the cooling air toward the tip end at a first target angle relative to the platform, and the second portion of film holes being configured to discharge the cooling air toward the root end at a second target angle relative to the platform, wherein an upper portion of the plurality of trailing edge slots is configured to discharge the cooling air from the turbine blade upward at a first trailing edge angle relative to the platform, a lower portion of the plurality of trailing edge slots is configured to discharge the cooling air from the turbine blade downward at a second trailing edge angle relative to the platform, the first target angle is substantially the same as the first trailing edge angle, the second target angle is substantially the same as the second trailing edge angle, the plurality of trailing edge slots includes a fan slot positioned between the upper portion of the plurality of trailing edge slots and the lower portion of the plurality of trailing edge slots, the fan slot being configured to discharge the cooling air upward, downward, and in between;

the first portion of film holes and the upper portion of the plurality of trailing edge slots extend between a film transition line and the tip end; and the second portion of film holes and the lower portion of the plurality of trailing edge slots extend between the film transition line and the platform.

6. The turbine blade of claim 5, wherein each film hole of the plurality of directional film holes is positioned downstream from the leading edge between sixty and ninety percent of a length from the leading edge to the trailing edge; and wherein each film hole of the plurality of directional film holes has a film hole discharge angle from the outer wall between 15 degrees and 45 degrees relative to a film transition line extending from the leading edge toward the trailing edge.

7. The turbine blade of claim 5, wherein the first portion of film holes extend from a film transition line as a first single-column spanwise array toward the tip end;

wherein the second portion of film holes extend from the film transition line as a second single-column spanwise array toward the platform;

wherein one of the first single-column spanwise array and the second single-column spanwise array is positioned upstream of the other;

wherein one film hole of the first portion of film holes is positioned on or between the film transition line and the platform; and wherein one film hole of the second portion of film holes is positioned on or between the film transition line and the tip end.

8. A turbine blade for use in a gas turbine engine, the turbine blade comprising:

a base including a blade root, a platform, a cooling air inlet, and a base air passageway within the base, the base air passageway being configured to receive cooling air from the cooling air inlet and route the cooling air through the base air passageway; and an airfoil section adjoined to the base, the airfoil section including an outer wall extending from the base to a tip end, the outer wall forming a leading edge, a trailing edge, a pressure side, and a suction side, an airfoil air passageway within the outer wall, the airfoil air passageway being configured to receive the cooling air from the base air passageway and route the cooling air through the airfoil air passageway, a plurality of trailing edge slots in fluid communication with the airfoil air passageway and configured to discharge a first percentage of the cooling air from the airfoil section, and a plurality of directional film holes through the outer wall and positioned downstream from the leading edge by at least half of a length from the leading edge to the trailing edge, the plurality of directional film holes being in fluid communication with the airfoil air passageway and being configured to discharge a second percentage of the cooling air, the plurality of directional film holes including a first portion of film holes and a second portion of film holes, the first portion of film holes being configured to discharge the cooling air toward the tip end at a first target angle relative to the platform, and the second portion of film holes being configured to discharge the cooling air toward the platform at a second target angle relative to the platform, wherein an upper portion of the plurality of trailing edge slots is configured to discharge the cooling air from the turbine blade upward at a first trailing edge angle relative to the platform, a lower portion of the plurality of trailing edge slots is configured to discharge the cooling air from the turbine blade downward at a second trailing edge angle relative to the platform, the first target angle is substantially the same as the first trailing edge angle, the second target angle is substantially the same as the second trailing edge angle, the plurality of trailing edge slots includes a fan slot positioned between the upper portion of the plurality of trailing edge slots and the lower portion of the plurality of trailing edge slots, the fan slot being configured to discharge the cooling air upward, downward, and in between, the first portion of film holes and the upper portion of the plurality of trailing edge slots extend between a film transition line and the tip end, and the second portion of film holes and the lower portion of the plurality of trailing edge slots extend between the film transition line and the platform.

9. The turbine blade of claim 8, wherein each film hole of the plurality of directional film holes is positioned downstream from the leading edge between sixty and ninety percent of a length from the leading edge to the trailing edge.

10. The turbine blade of claim 8, wherein the first portion of film holes extend as a first single-column spanwise array having a first beginning directional film hole nearest the tip end and a first ending directional film hole farthest from the tip end;

wherein the second portion of film holes extend as a second single-column spanwise array having a second beginning directional film hole nearest the platform and a second ending directional film hole farthest from the platform; and wherein the first ending directional film hole is equidistant or closer to the platform than the second ending directional film hole.

11. The turbine blade of claim 10, wherein one of the first single-column spanwise array and the second single-column spanwise array is positioned upstream of the other;

wherein one film hole of the first portion of film holes is positioned on or between a film transition line and the platform; and wherein one film hole of the second portion of film holes is positioned on or between the film transition line and the tip end.

12. The turbine blade of claim 8, wherein each film hole of the plurality of directional film holes has a film hole discharge angle from the outer wall between 15 degrees and 45 degrees relative to a film transition line extending from the leading edge toward the trailing edge.

13. The turbine blade of claim 8, wherein the first portion of film holes is further configured to discharge the cooling air upward at a first target angle between 10 degrees and 40 degrees in a positive direction toward the tip end; and wherein the second portion of film holes is further configured to discharge the cooling air downward at a second target angle between 10 degrees and 40 degrees in a negative direction toward the platform.

14. The turbine blade of claim 8, wherein the first trailing edge angle is between 10 degrees and 40 degrees and the second trailing edge angle is between 10 degrees and 40 degrees.

15. A gas turbine engine including a turbine having a turbine rotor assembly that includes the turbine blade of claim 8, the turbine rotor assembly being installed in a first stage of the turbine.

* * * * *